United States Patent [19]

Clarius

[11] Patent Number: 4,788,922

[45] Date of Patent: Dec. 6, 1988

[54] ADHESIVELY APPLIED SCHIFFLI EMBROIDERY

[75] Inventor: H. William Clarius, New Park, Pa.

[73] Assignee: Lion Brothers, Co., Inc., Owing Mills, Md.

[21] Appl. No.: 82,426

[22] Filed: Aug. 6, 1987

[51] Int. Cl.[4] ..... B32B 7/08; D05C 17/00

[52] U.S. Cl. ..... 112/403; 112/439; 2/244; 428/80; 428/187

[58] Field of Search ..... 112/439, 403, 266.1, 112/95, 97, 254; 28/168, 170; 57/239; 428/175, 187, 80; 2/244; 139/426 R

[56] References Cited

U.S. PATENT DOCUMENTS

| | | | |
|---|---|---|---|
| 1,171,154 | 2/1916 | Stern | 112/439 X |
| 1,341,160 | 5/1920 | Zust et al. | 112/95 |
| 1,869,386 | 8/1932 | Marzak | 112/439 |
| 2,714,758 | 8/1955 | Woodson | 112/262.1 X |
| 2,765,814 | 10/1956 | Jordan | 139/426 R |
| 3,252,484 | 5/1966 | Meyer et al. | 57/238 X |
| 3,463,692 | 8/1969 | Brunner | 112/439 X |
| 3,567,567 | 3/1971 | Sherrill | 428/86 |
| 3,658,023 | 4/1972 | Rossi | 28/168 |
| 3,816,211 | 6/1974 | Haigh | 112/439 X |
| 4,517,910 | 5/1985 | Jalowsky | 112/266.1 X |

*Primary Examiner*—H. Hampton Hunter

*Attorney, Agent, or Firm*—Marmorek, Guttman & Rubenstein

[57] ABSTRACT

An embroidered design adapted to be heat sealed to another article is disclosed. The embroidered design comprises a bobbin yarn forming a top surface of the embroidered design, and a needle or front yarn forming the bottom surface of the embroidered design. The needle yarn comprises first and second coextensive strands. One of the strands is made from a thermoplastic material which melts and forms an adhesive bond with the supporting article upon application of heat and pressure. The other strand remains intact upon application of heat and pressure. The second strand maintains the structural integrity of the embroidered design. The embroidered design also comprises a backing material disposed between the top and bottom surfaces which backing material is made from a degradable substance. The backing material disintegrates upon application of heat and pressure and may be brushed away.

20 Claims, 3 Drawing Sheets

ADHESIVELY APPLIED SCHIFFLI EMBROIDERY

BACKGROUND OF THE INVENTION

This invention relates to embroidery designs of the Schiffli type which are heat-sealed to a supporting article, such as a garment. More particulary, the invention relates to a new and improved Schiffli embroidery wherein the top surface is made from the bobbin yarn and the bottom surface is made from the needle yarn, and wherein a degradable backing material is disposed between the top surface and the bottom surface of the embroidery.

Embroidered designs have gained tremendous popularity in recent years. They have been used for the purpose of decorating many different kinds of articles of clothing, such as shirts, intimate apparel, etc., as well as textile fabrics, such as bed linens, towels, and the like.

At present, there are several known ways in which articles are decorated with embroidery. The first method is by direct embroidery. According to this method, the embroidery design is stitched directly into the article while the article is produced on a loom. Although this method produces an embroidery design which lasts the longest, this method suffers from several disadvantages. First, it requires the use of very capital intensive equipment. Second, there is a limitation on the number of embroideries that can be produced at a time. Thus, it is impractical to produce large numbers of embroidery designs in a short amount of time. Third, there will always be a number of damaged garments or pieces inherent in this process.

The other methods of embroidering articles seek to overcome the shortcomings of direct embroidery. According to these methods, the embroidery designs are mass produced as separate items and thereafter attached to the garment or textile fabric. Thus, individual designs may be embroidered on a suitable background of fabric and then cut to exact size before being secured to the garment or fabric by sewing. Sewing, however, is a time consuming, expensive operation. Accordingly, efforts have been made to secure embroideries to garments o fabrics by the use of thermoplastic adhesives. Several techniques have been described in the prior art for adhesively securing embroideries to a support fabric.

An example of one such technique for heat-sealing an 20 embroidery to an article is described in U.S. Pat. No. 3,463,692 (Brunner). According to this patent, an embroidery is produced in which the front or needle thread is made from a conventional natural or synthetic yarn, and the rear or bobbin thread is made from a thermoplastic material. The front thread is carried through a design fabric by the needle, looped around the bobbin thread, and pulled out of the design fabric. Bonding or fusing of the embroidered design to the support fabric, such as a garment, is accomplished by placing the embroidery onto the supporting fabric and subjecting the assembly to the heat and pressure of an electric heat-sealing machine. High temperatures created within the thermoplastic bobbin yarn cause it to melt and to bond with the fibers of the supporting fabric.

According to another technique described in U.S. Pat. No. 3,567,567 (Sherrill), an embroidered applique includes a top surface made from a conventional yarn, and a bottom surface made from a composite yarn. The composite yarn is comprised of two plied strands, one of which has a relatively low fusion temperature while the other has a much higher fusion temperature. When the embroidery design is applied to a supporting fabric and is subjected to heat and pressure, the strand of the composite yarn with the low fusion point becomes sufficiently soft to move into the interstices of the supporting fabric and thus adhesively secure the embroidery design to the supporting fabric. In the meantime, the strand of the composite yarn with the high fusion point remains intact and adds structural integrity to the embroidery design.

It is also known in the art to produce embroidery on a degradable backing material. U.S. Pat. No. 1,171,154 (Stern) discloses a method for preparing an embroidery on perishable backing material. The backing material is made from cotton and is treated with a weak solution of sulfuric acid. A design is embroidered onto the backing material. The design and backing material are then sewn onto a supporting fabric. Upon application of heat, the backing material degrades and may be brushed away. The backing material serves the dual purposes of supporting and displaying the design while exposed for sale, and enabling the design to be readily and accurately placed on the supporting fabric when it is permanently secured thereto.

Other prior art patents which disclose related techniques include U.S. Pat. Nos. 4,517,910 (Jalowsky); 3,252,484 (Mayer et al.); 3,657,060 (Haigh); 2,765,814 (Jordan); and 2,714,758 (Woodson).

None of the techniques described in the prior art is entirely satisfactory. For example, the technique disclosed in U.S. Pat. No. 3,463,692 (Brunner) does not provide an embroidery which maintains structural integrity. Once the bobbin thread is fused into the supporting fabric, the embroidery is weakened. As a result, there is a limitation on the size of the embroidery which may be applied to a supporting fabric by this technique.

The technique described in U.S. Pat. No. 3,567,567 (Sherrill) seeks to overcome this shortcoming by providing a bottom surface of the embroidery formed from two-plied strands, only one of which fuses into the supporting fabric. However, the technique described in this patent does not permit accurate control of the amount of adhesive and carrier yarn. Furthermore, the tensioning on the embroidery machine is inaccurate.

Another shortcoming of the prior art is that it does not provide for automatically aligning the disparate elements of an embroidery comprising separated elements. Thus, it is necessary to realign the separated elements of an embroidery design when they are transferred to the supporting fabric. Accordingly, it is an object of the present invention to overcome the deficiencies of prior art processes.

In particular, it is an object of the present invention to provide an embroidery design adapted to be heat-sealed to another article wherein the design may be of a large size.

It is another object of the present invention to provide an embroidery design adapted to be heat-sealed to another article wherein the structural integrity of the design is maintained after heat-sealing.

It is yet another object of the present invention to provide an embroidery design adapted to be heat-sealed to another article wherein the design is stitched onto a degradable backing material.

It is yet another object of the present invention to provide an embroidery design wherein separated elements of the design are transferred in place to the supporting fabric.

SUMMARY OF THE INVENTION

These and other objects are accomplished by means of the present invention which, in one of its aspects, constitutes an embroidery design adapted to be heat-sealed to another article. The design comprises a bobbin yarn forming a top surface of the design and a needle or "front" yarn forming a bottom surface of the design. The needle yarn is comprised of two coextensive strands. The first strand is made from a thermoplastic material which fuses into the supporting article when the design is subjected to heat and pressure at a predetermined temperature and is applied to the embroidery design. The second strand of the needle yarn is non-fusible at the predetermined temperature and maintains the structural integrity of the design after the first strand has been fused into the supporting article.

In another of its aspects, the present invention comprises the embroidery design described above and further includes a degradable backing layer disposed between the bobbin yarn and the dual-stranded needle yarn. The backing layer is made from a chemically treated material which disintegrates upon application of heat. At the sam time the embroidery design is heat-sealed to the supporting article, the backing material disintegrates and may be brushed away.

As a result of the present invention, heat-sealable embroidery designs can be prepared which have both a backing material, and a bottom surface which does not completely melt upon application of heat and pressure. Thus, much larger embroidery designs can be prepared and heat-sealed to a supporting article. In addition, the preparation of such articles can be controlled to a much more significant degree than was heretofore possible in the prior art.

DETAILED DESCRIPTION OF A PREFERRED EMBODIMENT

Figure 1:
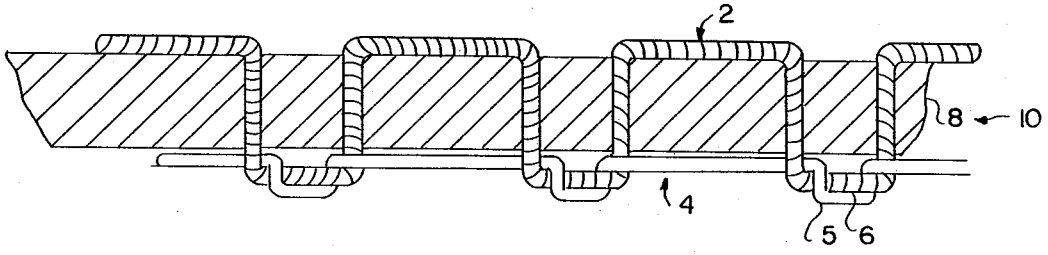
FIG. 1 illustrates in cross-section one particular embodiment of an embroidery design in accordance with the principles of the present invention.

The present invention will be described with reference to a Schiffli embroidery although it should be understood that the principles of the present invention can be applied to other kinds of embroideries as well. All Schiffli embroideries heretofore have been manufactured on a Schiffli loom through the use of a needle or front thread and a bobbin or back thread. Normally, a yarn such as rayon, cotton, or polyester, is threaded through the needle eye on the front of the Schiffli loom. This needle yarn forms the top thread of the embroidery. The shuttle on the back of the loom is loaded with a cotton, nylon, or polyester yarn. This yarn is called the bobbin or back thread and forms the bottom of the embroidery. After the needle penetrates the fabric, it pumps twice at the back of its stroke causing the needle yarn to form a loop. At the same time, the shuttle starts to move upwards passing through the loop, thus forming a normal stitch. The machine tension is adjusted so that the bobbin on the back pulls the needle yarn to the back of the fabric. When viewed from the rear, a properly adjusted loom will show approximately $\frac{1}{3}$ bobbin yarn and $\frac{2}{3}$ needle yarn on its rear side. The loom will show all needle yarn on its front side.

In accordance with the present invention, an embroidery design is prepared on a Schiffli machine by spanning a heat-degradable fabric across the loom. The heat-degradable fabric is used as the base fabric through which the embroidery will be stitched and form a backing layer for the embroidery design. Such heat-degradable fabrics are well known to those of ordinary skill in the art and may, for example, comprise a cellulosic material, e.g., viscose, pretreated with weak sulfuric acid. Desirably, the backing material degrades when subjected to a temperature in the range of about 350°–450° F.

Also in accordance with the present invention, the embroidery design is prepared by reversing the roles of the needle yarn and the bobbin yarn. The embroidery is stitched in a manner so that the front of the loom shows the bobbin yarn while the rear of the loom shows the needle yarn. Thus, the embroidery design is stitched in "mirror image" on the loom with the bobbin yarn forming the top of the embroidery and the needle or "front" yarn forming the bottom of the embroidery.

The needle yarn carried by the needle is comprised of two separate monofilaments or strands. One strand of the needle yarn is made from a thermoplastic adhesive material, such as a polyamide. This strand heat-seals the embroidery to the supporting fabric when heat is applied. Desirably, this strand has a melting point in the range of about 250°–350° F. The other strand of the needle yarn is either of the nonheat-sealable type or has a much higher melting point than the first strand. The second strand holds the embroidered design together after the first strand has melted. These two separate strands of the needle yarn are threaded through the same needle eye and are used to embroider the backside of the embroidery design.

The bobbin yarn can be any type of yarn, natural or synthetic, but in this case, a polyester yarn is preferred because of its durability and strength. The bobbin yarn becomes the top of the applique upon completion of the embroidery.

Referring now to FIG. 1, an embroidery design 10 made in accordance with the present invention is illustrated. The bobbin thread is shown by the numeral 2. This bobbin yarn, which preferably is made from polyester material, forms the top surface of the finished embroidery design. The needle yarn 4 forms the bottom surface of the finished embroidery design. It is comprised of two strands 5,6 which are coextensive with each other but are not necessarily twisted around each other. One strand 5 is made from a monofilament of a thermoplastic material, and the other strand 6 is made from a monofilament of a non-fusible material.

Between the bobbin yarn 2 forming the top surface of the finished embroidery and the needle yarn 4 forming the bottom surface of the finished embroidery is a heat-degradable backing material 8. Such materials are well known to those of ordinary skill in the art. Upon application of sufficient heat, for example, by means of a heat-sealing machine, the backing material disintegrates and may be brushed away. Typically, an embroidery design in accordance with the present invention will be secured to a supporting fabric by applying heat at a temperature of about 375° F. and pressure at 60 psi for a dwell time of 20 second. These conditions are sufficient to melt the thermoplastic material in the needle yarn on the bottom surface of the embroidery and heat-seal the embroidery to the supporting fabric. These conditions are also sufficient to degrade the backing layer. The second strand of the needle yarn remains in place and retains the structural integrity of the embroidery design. Once the applique has cooled, the degraded backing material can be brushed away leaving an embroidery that looks as if it was directly stitched into the supporting article.

It will be recognized that heat-sealing the embroidery design to the supporting fabric and degrading the backing material may be accomplished in a two-step procedure if desired. Thus, it is possible to heat-seal the embroidery design by, for example, applying heat from below, and thereafter to degrade the backing material by applying radiant heat from above. However, it is contemplated that in a typical operation, both heat-sealing and degrading will be accomplished in a single step.

The purpose of the backing layer is to prevent distortion of the stitches as the embroidery design is being made. It will be recognized that instead of a single backing layer, the embroidery design may be made with more than one backing layer. The use of multiple backing layers adds extra stability to the stitching and may be desirable in the case of a high stitch density. The setup of the loom to produce such embroidery designs in accordance with the present invention allows for strict control of the amount of adhesive and carrier yarn pulled on the back side of the loom. This is crucial to the performance of the embroidery once it is applied to the item or garment.

Figure 2:
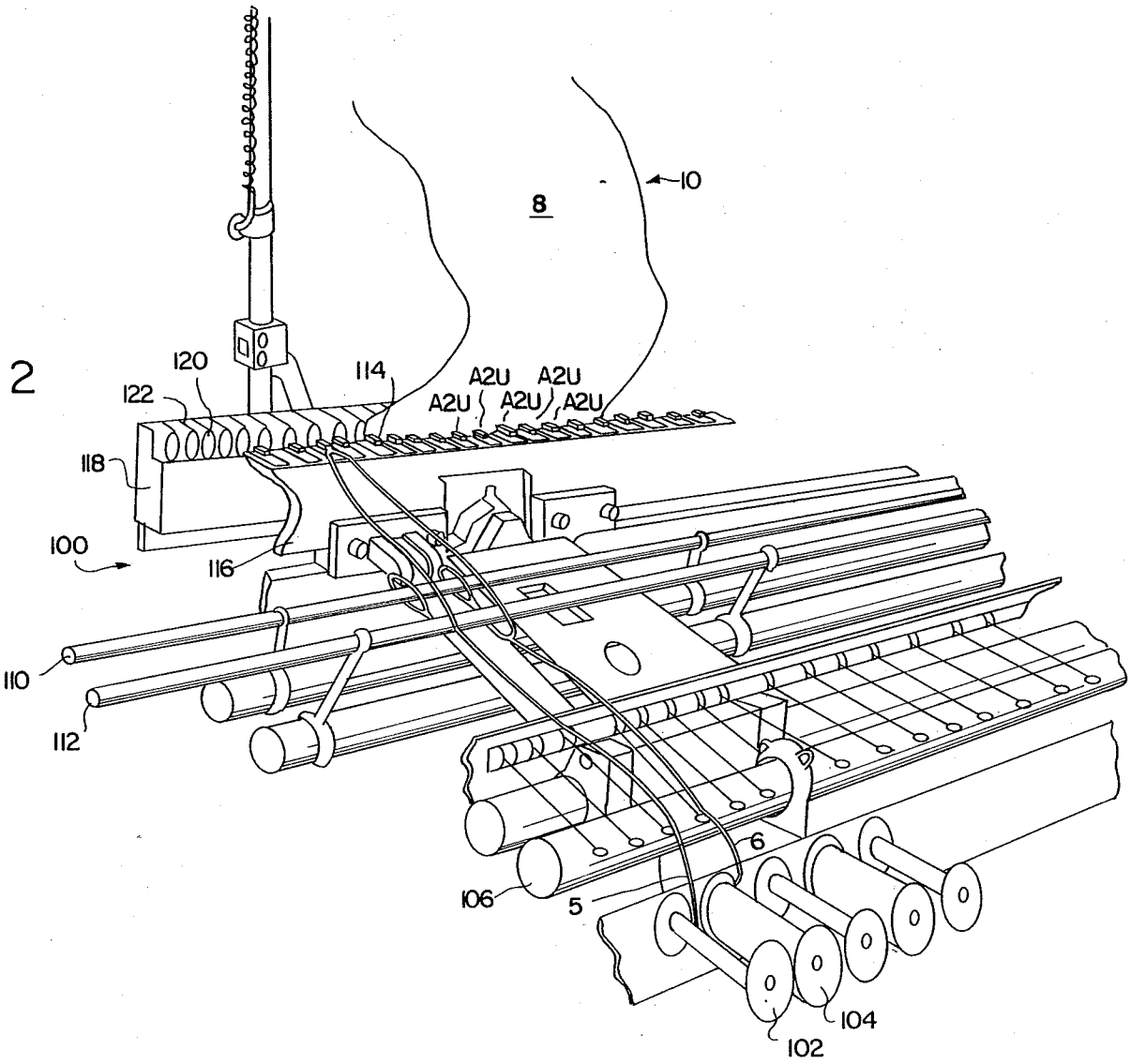
FIG. 2 is a perspective view of a loom which produces an embroidery design in accordance with the principles of the present invention.
Figure 3:
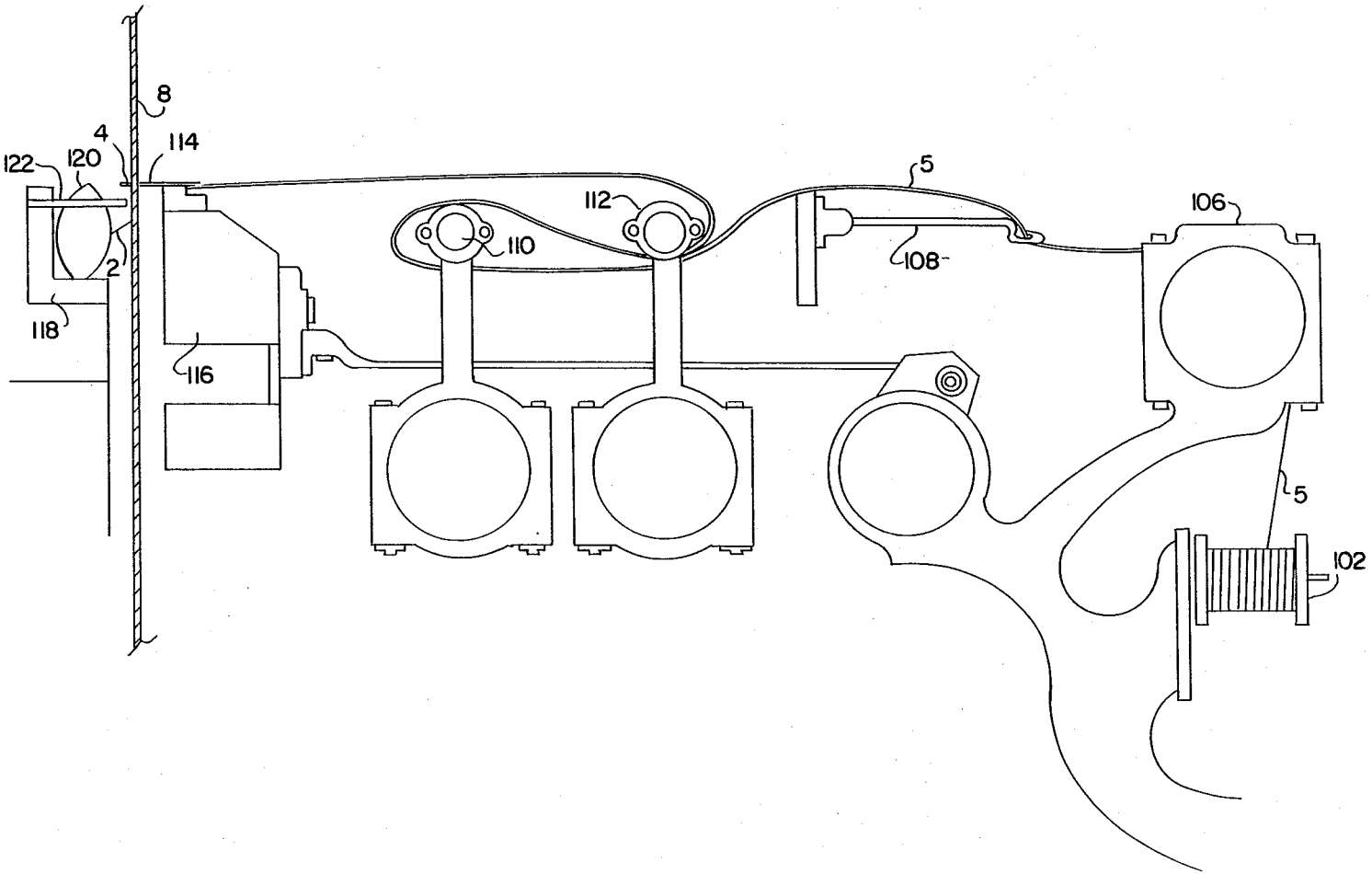
FIG. 3 is a sectional view of the loom illustrated in FIG. 2.

Referring now to FIGS. 2 and 3, a loom 100, for example a Schiffli loom, is illustrated in the process of making an embroidery design 10 of the present invention. FIG. 2 shows a view from the front of loom 100 while FIG. 3 shows a sectional view of loom 100. As illustrated, the two strands 5 and 6 which form the needle yarn 4 are supplied by spools 102 and 104 mounted on the front of loom 100. As mentioned previously, strand 5 is made from a monofilament of a thermoplastic material and strand 6 is made from a monofilament of a non-fusible material. Strands 5 and 6 are wound about tension roller 106, through electric watcher 108, which stops loom 100 if one of the strands breaks, and then under and around tension bars 110 and 112. This path is best illustrated in FIG. 3.

After passing about tension bars 110 and 112, strands 5 and 6 are brought together and pass into the eye (not shown) of one of needles 114. Together, strands 5 and 6 form the needle yarn 4. Needles 114 are carried on needle bar 116 which is cammed to reciprocate back and forth in carrying out the stitching process. On the back of loom 100 is shuttle bar 118 which carries a set of shuttles 120. Inside of each of the shuttles 120 is a bobbin (not shown) on which is wound the bobbin yarn 2. The bobbin yarn 2 emerges form a small opening in the shuttle. Shuttle bar 118 travels up and down in conjunction with the reciprocating motion of needle bar 116, the shuttles 120 being held in place by the shuttle slide 122.

The heat-degradable backing layer 8 of the embroidery design 10 is mounted between needle bar 116 and shuttle bar 118. The needles 114 carrying needle yarn 4, which is comprised of strands 5 and 6, pass through backing layer 8 and pump twice to form a loop. At the same time, the shuttles 120 move upward and the bobbin yarn 2 emerging from the shuttles 120 forms a stitch with the needle yarn 4. As illustrated in FIG. 2, the embroidery design 10 is stitched in "mirror image" as seen from the front of loom 100 with the bobbin yarn 2 forming the top of the embroidery design, and the needle yarn 4 forming the bottom of the embroidery.

After the design has been embroidered on the backing layer and removed from the loom, the embroidery design must be finished. This includes shredding away the front and back jump stitches from the embroidery, die cutting the embroidery from the loom, and packaging the embroidery in air tight bags in order to prevent decay of the chemically treated fabric cuts.

One major benefit of the present invention is that it permits an embroidery design having several separate elements to be applied to a supporting fabric without the need to realign the different elements. Thus, if an embroidery is comprised of different elements, for example, different letters of a name or several flowers, they are all produced on the Schiffli machine on the degradable backing layer in accordance with the principles of the present invention. All of the separate design elements are held in their proper places by the backing layer. When the embroidery is transferred to the supporting by the methods described above, each of the design elements is automatically secured to the supporting fabric in proper registration. There is no need for realignment of the elements and the backing layer is brushed away after it is degraded.

While the invention has been described by reference to specific embodiments, this was for purposes of illustration only and should not be construed to limit the spirit or the scope of the invention.

I claim:

1. A embroidered design adapted to be heat sealed to another article, comprising a bobbin yarn forming a top surface of said embroidered design, a needle yarn forming a bottom surface of said embroidered design, said needle yarn comprising first and second coextensive strands, said first strand being fusible at a predetermined temperature, said second strand being non-fusible at said predetermined temperature, and at least one backing layer disposed between said top surface and said bottom surface, said backing layer being degraded at said predetermined temperature.

2. The embroidered design of claim 1, wherein said bobbin yarn is made from a polyester material.

3. The embroidered design of claim 1, wherein said first and second strands are monofilaments.

4. The embroidered design of claim 1, wherein said first strand comprises a monofilament of a polyamide.

5. The embroidered design of claim 1, wherein said backing layer is made from a cellulosic material.

6. The embroidered design of claim 5, wherein said backing layer is chemically treated.

7. The embroidered design of claim 6, wherein said cellulosic material is treated with sulfuric acid.

8. The embroidered design of claim 1 comprising separated design elements.

9. An embroidered design adapted to be heat sealed to another article, comprising a bobbin yarn forming a top surface of said embroidered design, and a needle yarn forming a bottom surface of said embroidered design, said needle yarn comprising first and second coextensive strands, said first strand being fusible at a predetermined temperature, said second strand being non-fusible at said predetermined temperature.

10. The embroidered design of claim 9, wherein said bobbin yarn is made from a polyester material.

11. The embroidered design of claim 9, wherein said first and second strands are made from monofilaments.

12. The embroidered design of claim 9, wherein said first strand is made from a polyamide.

13. The embroidered design of claim 9, further comprising at least one backing layer disposed between said top and bottom surfaces, said backing layer being made from a material which degrades at said predetermined temperature.

14. The embroidered design of claim 13, wherein said backing layer is made from a cellulosic material.

15. An embroidered design adapted to be heat-sealed to another article, comprising a top layer, a bottom layer made from first and second coextensive strands, said first strand being fusible at a predetermined temperature, said second strand being non-fusible at said predetermined temperature, and at least one backing layer disposed between said top and bottom layers, said backing layer being degraded at said predetermined temperature.

16. The embroidered design of claim 15 wherein said top layer is made from a polyester material.

17. The embroidered design of claim 15 wherein said first and second strands comprise monofilaments.

18. The embroidered design of claim 15 wherein said first strand comprises a monofilament of a polyamide.

19. The embroidered design of claim 15 wherein said backing layer is made from a cellulosic material.

20. The embroidered design of claim 15 comprising separated design elements.

* * * * *